United States Patent [19]

Lybrand

[11] Patent Number: 5,064,387

[45] Date of Patent: Nov. 12, 1991

[54] SHIELDED ELECTRICAL JACK CONNECTOR

[75] Inventor: Brent B. Lybrand, Spartanburg, S.C.

[73] Assignee: Thomas & Betts Corporation, Bridgewater, N.J.

[21] Appl. No.: 536,811

[22] Filed: Jun. 12, 1990

[51] Int. Cl.[5] ..... H01R 13/648

[52] U.S. Cl. ..... 439/607; 439/676

[58] Field of Search ..... 439/607, 609, 610, 676

[56] References Cited

U.S. PATENT DOCUMENTS

| | | | |
|---|---|---|---|
| 3,680,031 | 7/1972 | Schumacher | 339/14 |
| 3,790,858 | 2/1974 | Brancaleone et al. | 317/99 |
| 4,296,991 | 10/1981 | Hughes et. al. | 339/176 |
| 4,438,998 | 3/1984 | Myers | 339/154 |
| 4,457,575 | 7/1984 | Davis et al. | 339/143 |
| 4,516,815 | 5/1985 | Venable et al. | 339/14 |
| 4,602,842 | 7/1986 | Free et al. | 339/156 |
| 4,624,515 | 11/1986 | Brush, Jr. et al. | 339/14 |
| 4,641,901 | 2/1987 | Brennan | 439/607 X |
| 4,648,665 | 3/1987 | Davis et al. | 439/607 X |
| 4,695,115 | 9/1987 | Talend | 439/76 |
| 4,781,623 | 11/1988 | Philippson et al. | 439/610 |
| 4,793,059 | 12/1988 | Moreau et al. | 29/854 |
| 4,838,811 | 6/1989 | Nakamura et al. | 439/607 |
| 4,875,872 | 10/1989 | Tanaka | 439/607 X |
| 4,878,858 | 11/1989 | Dechelette | 439/607 |
| 4,906,203 | 3/1990 | Margrave et al. | 439/188 |
| 4,941,848 | 7/1990 | Philippson et al. | 439/607 |
| 4,946,401 | 8/1990 | Hori et al. | 439/224 |
| 4,971,567 | 11/1990 | Mizuno et al. | 439/98 |

OTHER PUBLICATIONS

Du Pont Latch-N-Lok TM Modular Interconnections, Apr., 1985, 3 sheets.

Series 68290 Receptacle, Series 68293 Receptacle, Series 77226, 77227 and 77228 Plugs, Series 69273 Receptacle, Series 77835 Plug, 1 sheet, undated.

AMP-Interconnecting Ideas, 1 sheet, undated.

Drawing, entitled "Connector-Jack, Modular, 6POS/4 Wires", 1 (one) sheet, undated.

*Primary Examiner*—Larry I. Schwartz

*Assistant Examiner*—Julie R. Daulton

*Attorney, Agent, or Firm*—Robert M. Rodrick; Salvatore J. Abbruzzese

[57] ABSTRACT

A shielded electrical jack connector comprises an insulator having a cavity therewithin and an aperture communicating with the cavity through an outer surface thereof. The aperture defines a receptacle for receipt of a plug connector therein. A modular jack insert having an insulative body and supporting a plurality of electrical contacts, each being terminated to an insulated conductor, is retentively received in the insulator. The contacts of the jack insert extend into the insulator cavity in cantilevered fashion for access to complementary contacts of the mateable plug connector. An electrically conductive shield is supported by the insulator, the shield having an opening through which the insulated conductors of the insert extend. An electrically conductive ground contact is supported by the insulator in engagement with the shield, the ground contact comprising a terminal extending into the cavity for engagement with the plug connector upon receipt thereof into the receptacle. The jack connector of the subject invention has particular use in an interconnective adapter, wherein the insulated conductors are wired selectively to pin contacts of another connector of different connective configuration.

18 Claims, 7 Drawing Sheets

SHIELDED ELECTRICAL JACK CONNECTOR

FIELD OF THE INVENTION

The present invention relates to a shielded electrical connector and more particularly to a modular jack connector for use in the interconnection of peripheral computer equipment to a computer.

BACKGROUND OF THE INVENTION

In the modern office environment, various pieces of peripheral equipment, for example, printers or plotter devices are commonly interconnected to a main computer. Most computer input/output (I/O) connection interfaces are standard plug or socket RS 232 connectors. While some of the peripheral devices include cables terminated with compatible RS 232 connectors for mateable interconnection with the connector on the computer, it is not uncommon for the peripheral equipment to have a cable assembly terminated with connectors other than the standard RS 232. For example, peripheral devices may be terminated with telephone jacks or plugs.

When interconnecting a peripheral piece of equipment that is terminated with other than the standard RS 232 type connector, an adapter must be used to interconnect the two different types of connector configurations. For example, present known adapters are used to interconnect commercial telephone connectors to the standard RS 232 interfaces on a computer. It is also known that certain manufacturers of peripheral equipment terminate cables from the equipment with customized telephone connectors. With an adapter specifically configured to interconnect to the customized telephone connector, the manufacturers of the peripheral equipment may exercise a certain degree of control over which computers the peripheral equipment can be connected. Further, by interconnecting in the adapter the contacts of the customized telephone jack to selective pins of the commonly used 25 position RS 232 device, a further degree of control of the ability to connect peripheral equipment to computers may be exercised. In addition, it is desirable to provide an interconnective device that protects against electro magnetic interference (EMI). Accordingly, a shielded electrical jack connector with a customized aperture, which connector is to be subsequently wired to a different electrical connector, such as a standard RS 232 connector, is of interest for interconnective purposes.

SUMMARY OF THE INVENTION

It is a primary object of the present invention to provide a shielded electrical jack connector.

It is another object of the present invention to provide a shielded electrical jack connector for use in an adapter device wherein the jack connector includes conductors adapted for wiring to another connector of different configuration.

In accordance with a preferred form of the invention, a shielded electrical jack connector comprises an insulator defining a cavity therewithin. The insulator includes an exterior surface having an aperture formed therethrough, the aperture communicating with the cavity and defining a receptacle for receipt of a plug connector therein. The insulator is formed to include resilient latch means. A plurality of electrical contacts are supported by the insulator, the contacts extending into the insulator cavity. The contacts each terminate in a conductor.

An electrically conductive ground contact is supported by the insulator, the ground contact comprising a terminal extending into the insulator cavity for engagement with a plug connector upon receipt thereof Into the receptacle. The ground contact includes a friction surface projecting therefrom. An electrically conductive shield is supported on the insulator, the shield comprising cooperative latch structure for releasable retention with the insulator resilient latch means. An interior surface of the shield is in engagement with the friction surface on the ground contact. The shield has an opening therethrough, the conductors of the terminated contacts extending through such opening.

In accordance with another aspect of the present invention, a modular jack insert supporting the electrical contacts that are terminated with insulated conductors is provided. The insulator is formed to have a chamber communicating with the cavity, the insert being received in the chamber, the insulator having resilient means for releasably retaining the insert therewithin.

BRIEF DESCRIPTION OF THE DRAWINGS

FIG. 5 (*a*) is an exploded side elevation view of the insulator and insert of the connector of FIG. 1.

FIG. 5 (*b*) is an end view of the view shown in FIG. 4 (*a*).

FIG. 5 (*c*) is an exploded side elevation view of the assembly of FIG. 5 (*a*) and the ground contact.

FIG. 5 (*d*) is an exploded sectional view of the view of FIG. 5 (*c*) as seen along viewing lines IV—IV, showing the ground contact before and after assembly to the insulator.

FIG. 5 (*e*) is an exploded side elevation view of the assembly of FIG. 5 (*c*) and the shield, the shield being partially sectioned to show inner details thereof.

FIG. 5 (*f*) is an end elevation view of the view of FIG. 5 (*e*).

DETAILED DESCRIPTION OF THE PREFERRED EMBODIMENT

Figure 1:
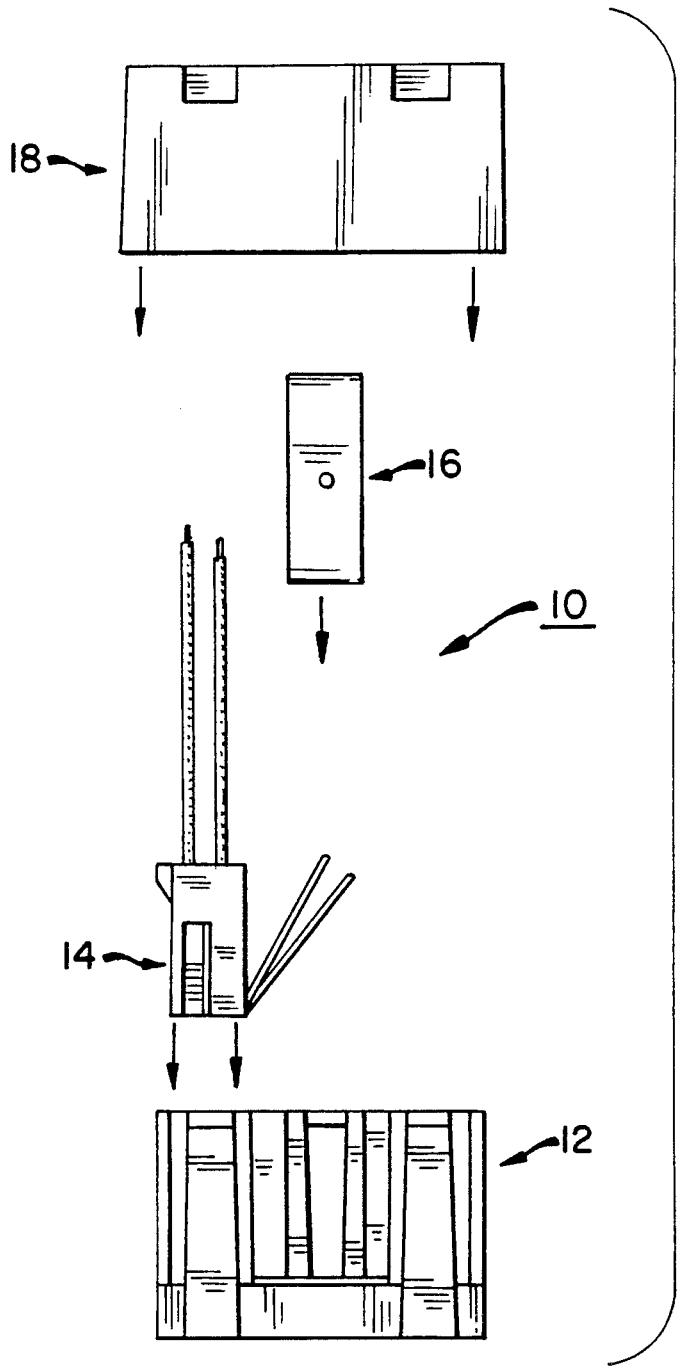
FIG. 1 is an exploded side elevation view showing the components of a preferred form of the shielded electrical connector jack connector of the present invention.

Turning now to the drawing figures, there is shown in FIG. 1 an exploded view of a shielded modular electrical jack connector 10 in accordance with a preferred embodiment of the present invention. Jack connector 10 basically comprises an insulator 12, a modular jack insert 14, a ground contact 16 and a cover shield 18. As will be described herein below, jack connector 10 is particularly useful in an adapter that permits interconnection between a peripheral device and a computer which have differently configured input/output connectors.

Figure 2A:
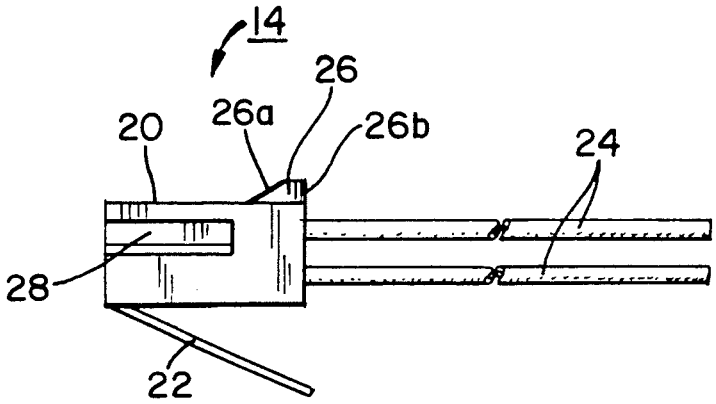
FIG. 2 (*a*) and FIG. 2 (*b*) are side elevation and end elevation views, respectively, of a commercially available modular jack insert used as one of the elements of the preferred form f the connector of FIG. 1.
Figure 2B:
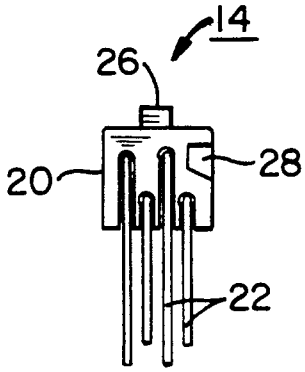

Referring now to FIGS. 2 (*a*) and 2 (*b*), the modular jack insert is preferably a complete assembly, commercially available from DuPont. Insert 14 comprises an insulative body 20, preferably of thermoplastic material, supporting a plurality of electrical contacts 22 that are individually terminated to a respective insulated conductor 24. Electrical contacts 22 are formed of electrically conductive material, such as a copper alloy, and are supported by the insulative insert body 20 in exposed, cantilevered, deflectable fashion. In the preferred insert, there are four electrical contacts 22 and terminated conductors 24 projecting outwardly from the insert body 20, it being understood that other numbers of contacts and conductors may be used. Insert body 20 includes a projecting locking member 26 having an inclined surface 26*a* and a generally flat locking surface 26*b*. A recess 28 is formed into and partially along one of the sides of the insulative body 20.

Figure 3:
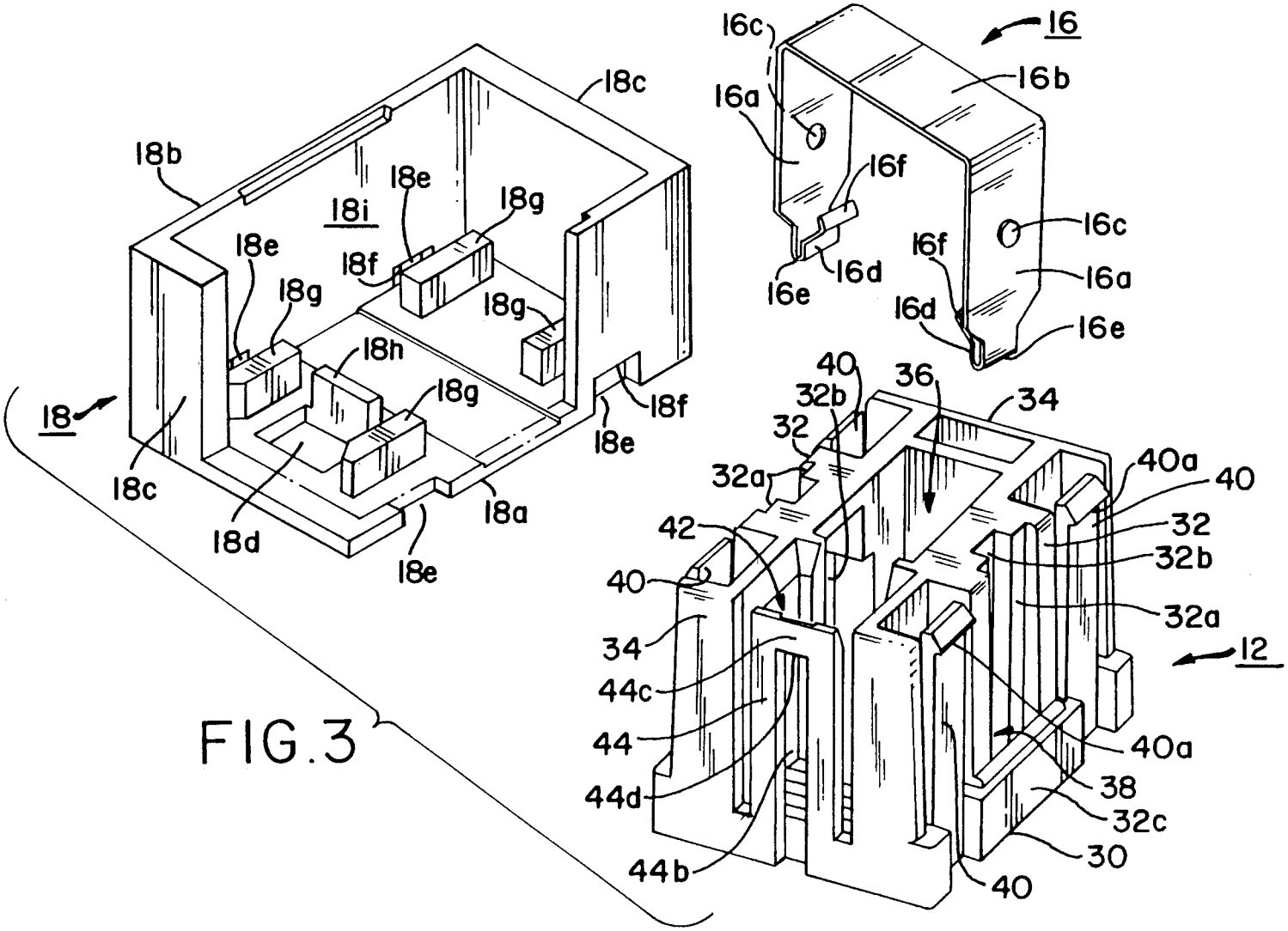
FIG. 3 is a top perspective view of the insulator and ground contact of the jack connector of FIG. 1 and an inverted view of the shield of the jack connector of FIG. 1 partially broken away to show interior details thereof.

Turning now to FIG. 3, further details of the insulator 12, the ground contact 16 and the shield 18 are illustrated. The insulator 12, preferably formed of an insulative material such as glass-filled polyester, is configured in a generally rectangular block form having a base 30, a pair of spaced opposing sidewalls 32 upstanding from base 30 and a pair of spaced opposing endwalls 34 projecting upwardly from base 30. A generally centrally located cavity 36 extends into the insulator 12 between the sidewalls 32 and the endwalls 34. Formed in each of the sidewalls 32 is a recessed track 32*a* for guided receipt of the ground contact 16. In registry with track 32*a* through each of the sidewalls 32 is an opening 32*b* which communicates with the cavity 36. Adjacent the base 30 in each of the sidewalls 32 is a pocket 38 defined by an outer wall portion 32*c* and an inner wall portion 32*d* of each of the sidewalls 32 as seen further with reference to FIG. 5 (*d*).

At each of the sidewalls 32, preferably adjacent the endwalls 34, there are formed resiliently deflectable latching members 40. Each of the latching members 40 upstands from insulator base 30 in a cantilevered manner and terminates at its free distal end in a generally flat, protruding latching ledge 40*a*.

Formed in communication with the insulator cavity 36 and preferably disposed adjacent to and in communication with one of the endwalls 34, is a chamber 42. Chamber 42 is particularly configured to receive in resilient, retentive fashion the insulative body 20 of the jack insert 14. The endwall 34 adjacent the chamber 42 comprises a resilient latch 44 for releasably retaining the insert 14 in the chamber 42. Latch 44 upstands from the insulator base 30 in cantilevered manner and comprises a frame defined by two vertically projecting and transversely spaced elements 44*a* defining a slot 44*b* therebetween, elements 44*a* being connected at the free distal ends by a connecting element 44*c*. The lower edge 44*d* of connecting element 44*c* defines a cooperative latching structure for resiliently engaging the locking surface 26*b* of the locking member 26 of the jack insert 14.

Figure 4:
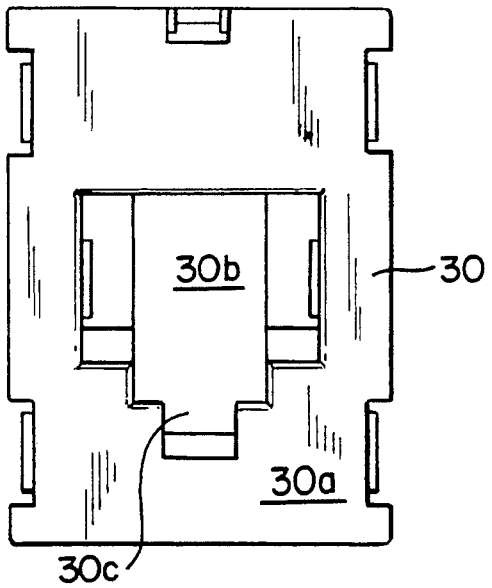
FIG. 4 is a bottom plan view of the insulator of the connector jack of FIG. 1.
Figure 5B:
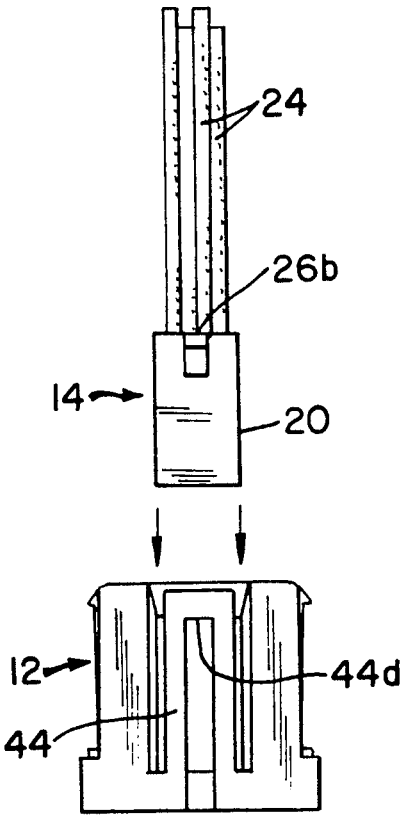
FIGS. 5 (*a*) through 5 (*f*) illustrate the sequence of assembly of the preferred jack connector of FIG. 1.
Figure 5A:
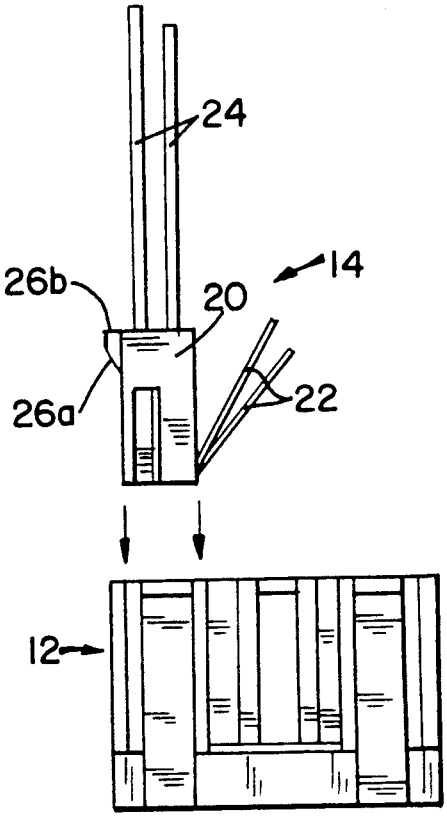
Figure 5C:
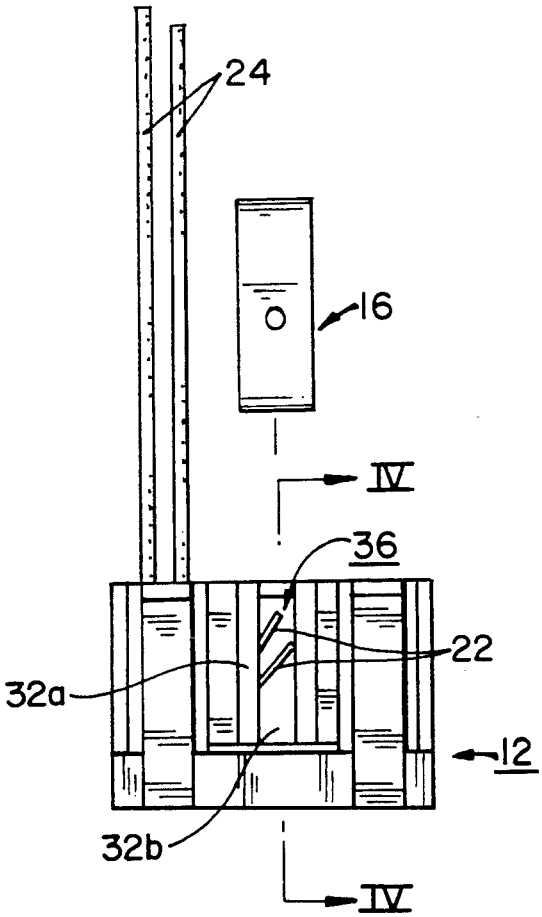
Figure 5D:
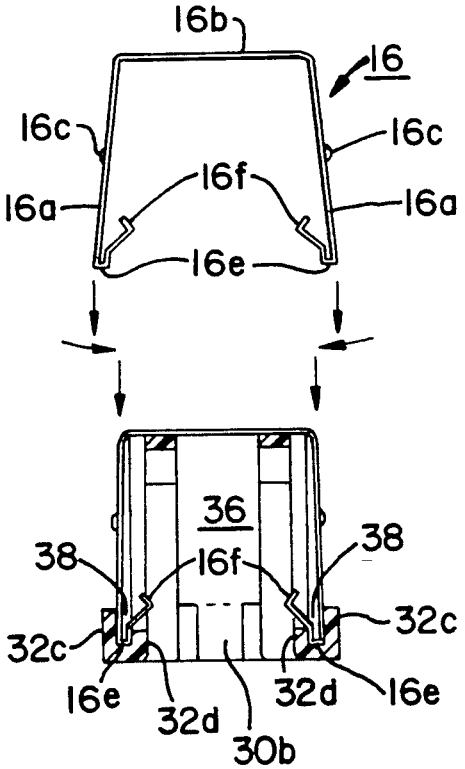
Figure 5E:
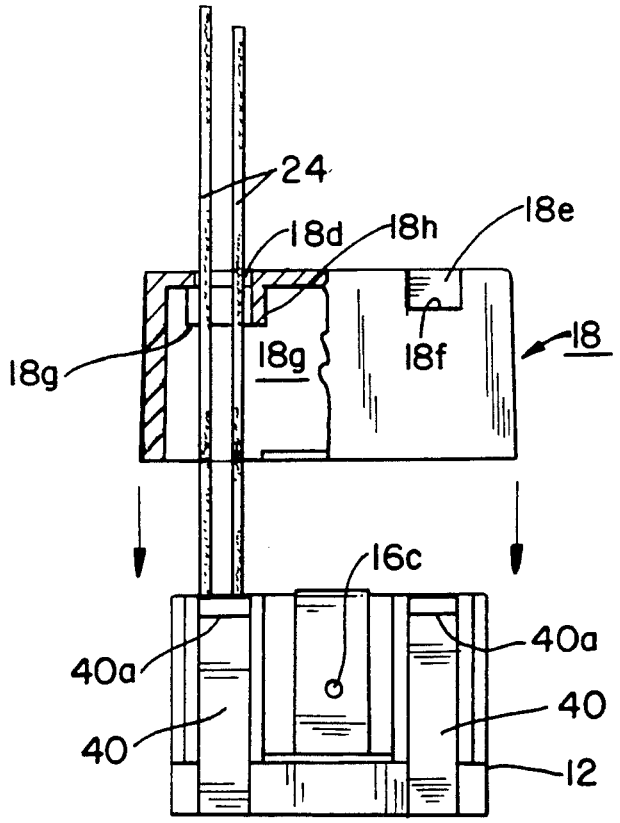
Figure 5F:
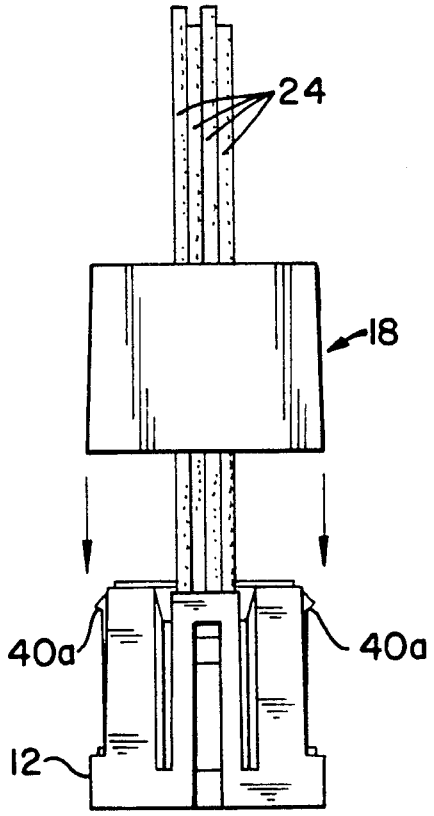

As illustrated in FIG. 4, the base 30 of the insulator 12 has an exterior surface 30*a* through which an aperture 30*b* is formed in communication with the insulator cavity 36. The aperture 30*b* defines a receptacle and is adapted to receive therein a complementary, mateable plug connector for engagement with the contacts 22 of the jack insert, as will be described hereinafter. One edge of the walls defining the aperture 30*b* is particularly configured to have a key-way 30*c* of size and shape to only receive a plug connector having like size and shape. As such, the type of connector which may be received in aperture 30*b* may be controlled.

Referring again to FIG. 3 and also to FIG. 5 (*d*), the details of the ground contact are illustrated. The ground contact 16 is formed of an electrically conductive material, such as a copper—nickel—tin alloy, and is preferably formed from a stamped, generally flat sheet. Contact 16 comprises a pair of spaced opposing legs 16*a* and a connecting portion 16*b*. As illustrated, the contact is in a generally inverted U-shape configuration. Formed in each of the legs 16*a* is a recess or dimple punched into each of the legs 16*a* and defining an outwardly projecting, raised bump 16*c* of generally semi-hemispherical configuration. Raised bumps 16*c* provide a friction surface for engagement with the shield 18 as will be set forth subsequently. At the free distal ends of each of the legs 16*a* there is provided a reversely bent portion 16*d* interconnected by a curved bight 16*e*. The reversely bent portions 16*d* are bent inwardly towards each other and each respectively terminate in a terminal 16*f*. The terminals 16*f* are each configured to be received in a respective sidewall opening 32*b* and to extend into the insulator cavity 36*c*, as depicted in FIG. 5 (*d*). As further illustrated in 5 (*d*), the depending legs 16*a* of the ground contact 16 are formed to have a slightly outward configuration to provide a biased, frictional receipt in the insulator 12 as will be described.

Referring still to FIG. 3, the cover shield 18 is shown in inverted, partially sectioned view to reveal details of the shield 18. Shield 18 comprises a cover surface 18*a* from which depend opposing, spaced side surfaces 18*b* and opposing, spaced end surfaces 18*c*. Through the shield cover surface 18*a* is an opening 18*d* located to be in registry with the insulator chamber 42 upon receipt of the shield onto the insulator 12. Formed approximately at the four corners of the shield 18 and disposed through each of the side surfaces 18*b* and partially through cover surface 18*a* is a hole 18*e* for receipt of the latching member 40. An edge surface 18*f* of each hole 18*e* serves as a latching surface for releasable, retentive engagement with the latching ledges 40*a* on the latching members 40. Adjacent each of the holes 18*e*, there is provided a raised block 18*g* which forms a barrier for minimizing subsequent flow of a potting compound into the interior of the shield. Similarly, a wall 18*h* is provided adjacent the opening 18*d*, which wall 18*h* also serves as a further support for the insert 14 upon assembly. An interior wall surface 18*i* on each of the side surfaces 18*b* is adapted to be engaged with the raised bumps 16*c* on the ground contact, such that the ground contact 16 and the shield 18 are provided in electrically common potential. The shield is formed of electrically conductive material and is preferably of a zinc alloy.

By reference to FIGS. 5 (*a*) through 5 (*f*), the assembly sequence of the jack connector 10 may be understood. FIGS. 5 (*a*) and 5 (*b*) illustrate the assembly of the modular jack insert 14 to the jack connector insulator 12. The insert body 20 is received in the insulator chamber 42, with the locking member 26 resiliently received by the insulator latch 44, the locking surface 26*b* being in cooperative engagement with the lower edge 44*d* upon receipt of the body 20 in the chamber 42.

During insertion of the body 20 in the chamber 42, the inclined surface 26*a* outwardly deflects the latch 44 until the lower edge 44*d* engages the locking surface 26*b*. In assembly, the contacts 22 extend in cantilevered fashion into the insulator cavity 36, the insulated conductors 24 projecting upwardly from the upper surface of the insulator 12.

Turning now to FIGS. 5 (*c*) and 5 (*d*), the attachment of the ground contact 16 to the connector insulator 12 is illustrated. During attachment of the ground contact to the insulator 12, the outwardly disposed legs are urged inwardly to create a bias and the legs 16*a* are received in the recessed tracks 32*a* on the insulator sidewalls 32. The bight 16*e* of each of the legs 16*a* is seated in a respective pocket 38 formed at the base of each of the sidewalls 32, as illustrated in FIG. 5 (*d*). Upon seating of the contact 16 with the legs 16*a* in respective pocket 38, the contact is frictionally retained as a result of the bias of the contact 16, and the terminals 16*f* project through the sidewall openings 32*b* and into the insulator cavity 36. The connecting portion 16*b* of the ground contact 16 traverses the insulator cavity 36 spanning the sidewalls 32 of the insulator 12 upon assembly thereto.

By reference to FIGS. 5 (*e*) and 5 (*f*), the attachment of the shield to the insulator is shown. The insulated conductors 24, which project outwardly from the insulator 12 are fed through the opening 18*d* in the shield 18. As the shield is progressively assembled over the insulator 12, the raised bumps 16*c* on the ground contact slide against the interior surface 18*i* of the shield 18, removing any oxides that may be formed on the raised bumps 16*c* for better electrical connection between the shield 18 and ground contact 16. Upon completing the assembly of the shield to the insulator 12, the latching ledges 40*a* engage the latching edge surface 18*f* of the holes 18*e*, resulting in retention of the shield 18 to the insulator 12.

Figure 6:
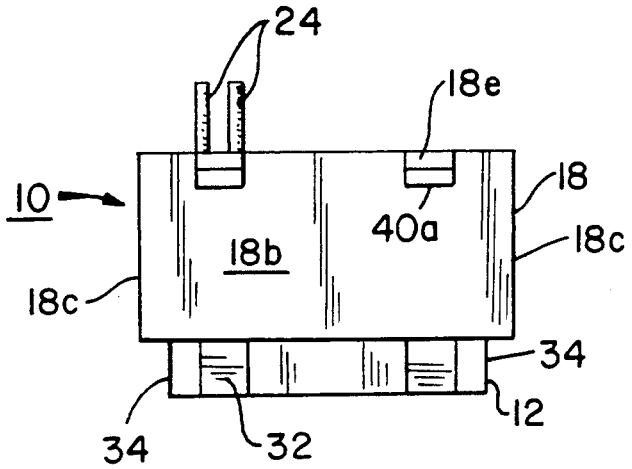
FIG. 6 is a side elevation view of the complete assembly of the jack connector of FIG. 1.
Figure 7:
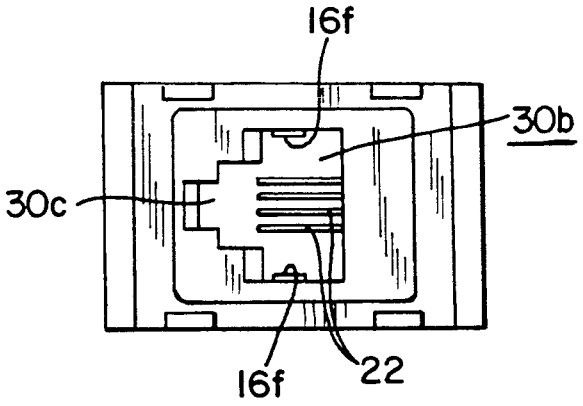
FIG. 7 is a bottom plan view of the complete connector of FIG. 6.

The completed assembly of the jack connector 10 is illustrated in FIGS. 6 and 7. In assembly, the side surfaces 18*b* and the end surfaces 18*c* of the shield 18 extend nearly fully along the sidewalls 32 and endwalls 34 respectively of the insulator 12. As depicted in FIG. 7, the contacts 22 are disposed for access to contacts of a complementary plug through the particularly configured aperture 30*b* formed through the base of the insulator 12. Such a plug connector may be a customized telephone connector having its housing configured to be received in the key 36*c* formed in the insulator base.

The jack connector 10 of the subject invention has particular utility in an interconnection adapter which includes the jack connector 10 (having one configuration) and another connector (not shown), such as a standard RS 232 connector (having a different configuration). Thus, a peripheral device terminated by a connector of one configuration can be connected to a computer having a connector of different configuration. In such an adaptor, the insulated conductors 24 may also be selectively wired to pins (plug or socket) of the other connector having the different from the configuration. For example, the standard RS 232 connector usually has more than four contacts and typically has twenty-five contacts. Accordingly, by selectively wiring four pins of an RS 232 connector to the four conductors of the jack connector 10, further control of the inter-connection capabilities of an adapter can be achieved.

Having described the preferred arrangement of the subject jack connector, it should be understood that variations may be made thereto without departing from the contemplated scope of the invention. Accordingly, the preferred embodiment described herein is intended in an illustrative rather than a limiting sense. The true scope of the invention is set forth in the claims appended hereto.

I claim:

1. A shielded electrical jack connector, comprising:

an insulator defining a cavity therewithin, said insulator including an exterior surface having an aperture formed therethrough, said aperture communicating with said cavity and defining a receptacle for receipt of a plug connector, said insulator including resilient latch means and a base which includes said exterior surface through which said aperture is formed, and a pair of spaced, opposing sidewalls upstanding from said base;

a plurality of electrical contacts supported by said insulator and extending into said cavity, said contacts each terminating in a projecting conductor;

an electrical conductive ground contact supported by said insulator, said ground contact comprising a terminal extending into said cavity for engagement with a plug connector upon receipt thereof into said receptacle and a friction surface projecting therefrom, said ground contact including a pair of opposed legs and a connecting portion, each leg being supported by a respective different one of said opposing sidewalls; and an electrically conductive shield supported on said insulator, said shield comprising cooperative latch structure for releasable retention with said insulator resilient latch means and an interior surface in engagement with said friction surface on said ground contact, said shield comprising a cover surface extending over and communicating with said cavity and having an opening through said cover surface, through which said projecting conductors extend.

2. A shielded electrical jack connector according to claim 1, wherein said conductors extending through said shield opening each include insulation thereon.

3. A shielded electrical jack connector according to claim 1, wherein said ground contact is supported by one of said sidewalls.

4. A shielded electrical jack connector according to claim 3, wherein said friction surface includes a raised bump projecting outwardly from a surface of said ground contact.

5. A shielded electrical jack connector according to claim 1, wherein each of said legs comprises a reversely bent portion defining a respective terminal, said reversely bent portions being attached to said legs by a curved bight and projecting towards each other inwardly of said legs.

6. A shielded electrical jack connector according to claim 5, wherein each of said sidewalls has adjacent said base a pocket formed therein for frictional receipt therein of a respective bight of said legs.

7. A shielded electrical jack connector according to claim 6, wherein each of said legs comprises a raised bump projecting outwardly therefrom and defining a respective friction surface in engagement with said interior surface of said shield.

8. A shielded electrical jack connector according to claim 1, wherein said insulator latch means comprises plural latches.

9. A shielded electrical jack connector according to claim 8, wherein plural latches each comprise a cantilevered member upstanding from said base along both of said sidewalls, each said cantilevered member terminating at its free end in a latching ledge in engagement with said shield latch structure.

10. A shielded electrical jack connector comprising:

a modular jack insert including an insulative body supporting a plurality of electrical contacts projecting from said body in cantilevered fashion, said contacts each being terminated to an insulated conductor, which insulator conductors project outwardly from said body;

an insulator defining a cavity therewithin, said insulator including an exterior surface having an aperture formed therethrough, said aperture communicating with said cavity and defining a receptacle for receipt of a plug connector, said insulator supporting said modular jack insert and having resilient means for releasably retaining said insert, said cantilevered contacts of said insert extending into said cavity;

an electrically conductive shield supported by said insulator, said insulator, said shield having an opening through which said insulated conductors of said insert project; and an electrically conductive ground contact in engagement with said shield, said ground contact comprising a terminal extending into said cavity for engagement with a plug connector upon receipt thereof into said receptacle, said ground contact including opposed legs each comprising a respective friction surface thereon, said ground contact including a connecting portion traversing said insulator cavity and being disposed beneath and adjacent to said shield cover surface.

11. A shielded electrical jack connector according to claim 10, wherein said insulator comprises a base which includes said exterior surface through which said aperture is formed, a pair of spaced, opposing sidewalls upstanding from said base and a pair of spaced, opposing endwalls upstanding from said base.

12. A shielded electrical jack connector according to claim 11, wherein insulator has a chamber communicating with said cavity, said insert body being received in said chamber.

13. A shielded electrical jack connector according to claim 12, wherein said chamber communicates with one of said endwalls, said one of said endwalls including a resilient portion defining said resilient means releasably retaining said insert.

14. A shielded electrical jack connector according to claim 13, wherein said one endwall resilient portion comprises a resiliently deflectable latch extending upwardly from said base in cantilevered fashion and having a surface thereon for cooperative engagement with a surface of said insert body.

15. A shielded electrical jack connector according to claim 11, wherein said shield comprises surfaces extending along each of said sidewalls and said endwalls and a cover surface extending over said cavity, said opening extending through said cover surface and being in registry with said insulator chamber.

16. A shielded electrical jack connector according to claim 15, wherein said insulator comprises resilient latch means for releasably retaining said shield to said insulator.

17. A shielded electrical jack connector according to claim 16, wherein said ground contact is supported by said insulator and comprises a friction surface adjacent each of said sidewalls in engagement with an interior surface of said shield.

18. A shielded electrical jack connector, comprising:

an insulator defining a cavity therewithin, said insulator including an exterior surface having an aperture formed therethrough, said aperture communicating with said cavity and defining a receptacle for receipt of a plug connector, said insulator comprising a base which includes said exterior surface through which said aperture is formed, and a pair of spaced, opposing sidewalls upstanding from said base;

a plurality of electrical contacts supported by said insulator and extending into said cavity, said contacts each terminating in a conductor;

an electrical conductive ground contact supported by said insulator, said ground contact being generally flat and comprising a pair of opposed legs and a connecting portion, each of said legs being supported by one of said opposing sidewalls, each of said ground contact legs comprising a reversely bent portion defining a terminal, said reversely bent portions being attached to said legs by a curved bight and projecting towards each other inwardly of said legs, each of said terminals extending into said cavity for engagement with a plug connector upon receipt thereof into said receptacle, said ground contact comprising a friction surface projecting therefrom; and an electrically conductive shield supported on said insulator, said shield comprising an interior surface in engagement with said friction surface on said ground contact, said shield having an opening through which said conductors extend.

* * * * *